US009791109B2

(12) United States Patent
Jeong et al.

(10) Patent No.: US 9,791,109 B2
(45) Date of Patent: Oct. 17, 2017

(54) MECHANOLUMINESCENT DISPLAY DEVICE

(71) Applicant: Daegu Gyeongbuk Institute of Science and Technology, Daegu (KR)

(72) Inventors: Soon Moon Jeong, Daegu (KR); Seong Kyu Song, Daegu (KR)

(73) Assignee: Daegu Gyeongbuk Institute of Science and Technology, Daegu (KR)

( * ) Notice: Subject to any disclaimer, the term of this patent is extended or adjusted under 35 U.S.C. 154(b) by 0 days.

(21) Appl. No.: 14/908,209

(22) PCT Filed: Dec. 10, 2014

(86) PCT No.: PCT/KR2014/012089
§ 371 (c)(1),
(2) Date: Jan. 28, 2016

(87) PCT Pub. No.: WO2015/190661
PCT Pub. Date: Dec. 17, 2015

(65) Prior Publication Data

US 2016/0169453 A1 Jun. 16, 2016

(30) Foreign Application Priority Data

Jun. 10, 2014 (KR) ..... 10-2014-0070171

(51) Int. Cl.
*F21K 2/04* (2006.01)

(52) U.S. Cl.
CPC ..... *F21K 2/04* (2013.01)

(58) Field of Classification Search
CPC ..... F21K 2/04; G09F 9/00
See application file for complete search history.

(56) References Cited

U.S. PATENT DOCUMENTS

2004/0120684 A1* 6/2004 Ishibashi ..... C09K 11/7734 385/141
2006/0066586 A1* 3/2006 Gally ..... G06F 3/045 345/173
2009/0050847 A1* 2/2009 Xu ..... C09K 11/7706 252/301.4 R (Continued)

FOREIGN PATENT DOCUMENTS

JP 2003-140569 A 5/2003
JP 2005-300587 A 10/2005

OTHER PUBLICATIONS

Soon Moon Jeong et al., "Mechanically driven light-generator with high durability," Applied Physics Letters, Feb. 2013, pp. 051110-1-051110-5, vol. 102.

(Continued)

*Primary Examiner* — Mary Ellen Bowman
(74) *Attorney, Agent, or Firm* — Sughrue Mion, PLLC

(57) ABSTRACT

Provided is a display device in a mechanical method using wind, vibration. The mechanoluminescent display device includes a substrate having a predetermined shape, and projections formed with a predetermined pattern on the substrate. The projections are formed of a mixture of a stress luminescent material emitting light by mechanical energy which is applied and a stress transmission material transmitting the mechanical energy applied from the outside to the stress luminescent material.

4 Claims, 9 Drawing Sheets

Optical characteristics of the ML composites. a-c, ML spectra from ML composites (B+, G+ and O+PDMS) during S-R motion (Upper inset: relative intensity ratio. Lower inset: photograph of the S-R motion induced ML under 100 cpm condition) and d, brightness under various S-R conditions (from 100 cpm to 500 cpm with 100 step). e, Comparison between ML (500 cpm) and EL (B+, G+PDMS: 10 Hz, O+PDMS: 50 Hz). Note that O+PDMS driven below 50 Hz frequency conditions does not emit detectable ML. f, The CIE coordinates (x, y) values of ML and EL depicted in e.

(56) References Cited

U.S. PATENT DOCUMENTS

| | | | | |
|---|---|---|---|---|
| 2009/0061202 | A1* | 3/2009 | Xu | C09K 11/666<br>428/304.4 |
| 2011/0175546 | A1 | 7/2011 | Ramer et al. | |

OTHER PUBLICATIONS

International Searching Authority, International Search Report for PCT/KR2014/012089 dated Apr. 3, 2015.

* cited by examiner

FIG.1

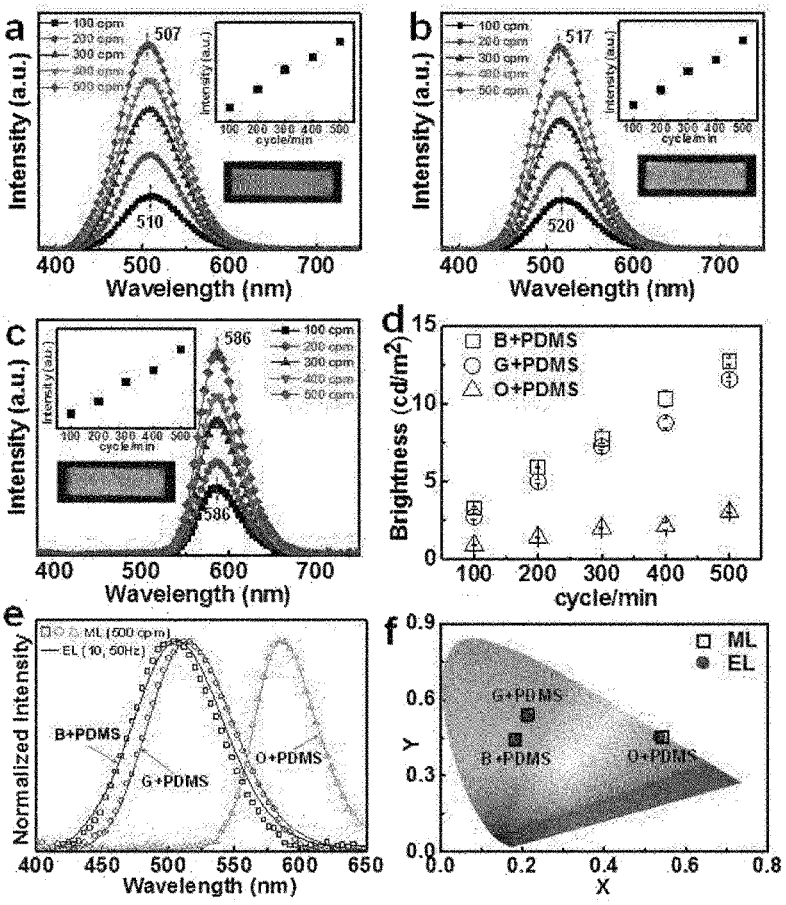

Fig. 1. Optical characteristics of the ML composites. a-c, ML spectra from ML composites (B+, G+ and O+PDMS) during S-R motion (Upper inset: relative intensity ratio. Lower inset: photograph of the S-R motion induced ML under 100 cpm condition) and d, brightness under various S-R conditions (from 100 cpm to 500 cpm with 100 step). e, Comparison between ML (500 cpm) and EL (B+, G+PDMS: 10 Hz, O+PDMS: 50 Hz). Note that O+PDMS driven below 50 Hz frequency conditions does not emit detectable ML. f, The CIE coordinates (x, y) values of ML and EL depicted in e.

FIG.2

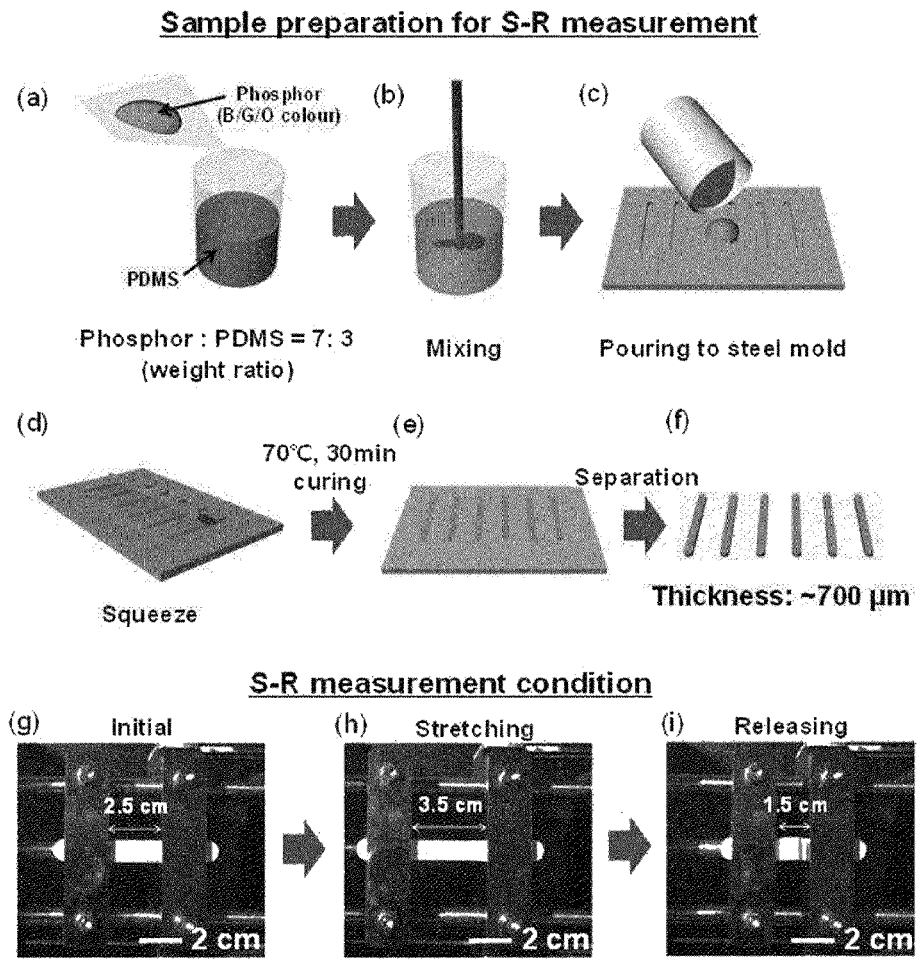

Fig. 2. Schematic illustration of sample preparation and measurement condition in S-R test. For the samples, mixed or unmixed (= pure) phosphors poured into PDMS solution (a) and mixed well (b). This mixed solution poured to the steel mold that acts as a template (c). After squeezing (d), cure the solution at 70 °C for 30 min (e). The ML composites for S-R measurement are prepared by separating ML from the steel mold (f). For the S-R measurement, (g) sample is mounted on S-R system without any deformation (2.5cm). (h)-(i) show the photographs of the stretching (3.5cm) and releasing (1.5cm) of ML sample. The S-R process shown in (h)-(i) is defined as 1 cycle.

FIG.3

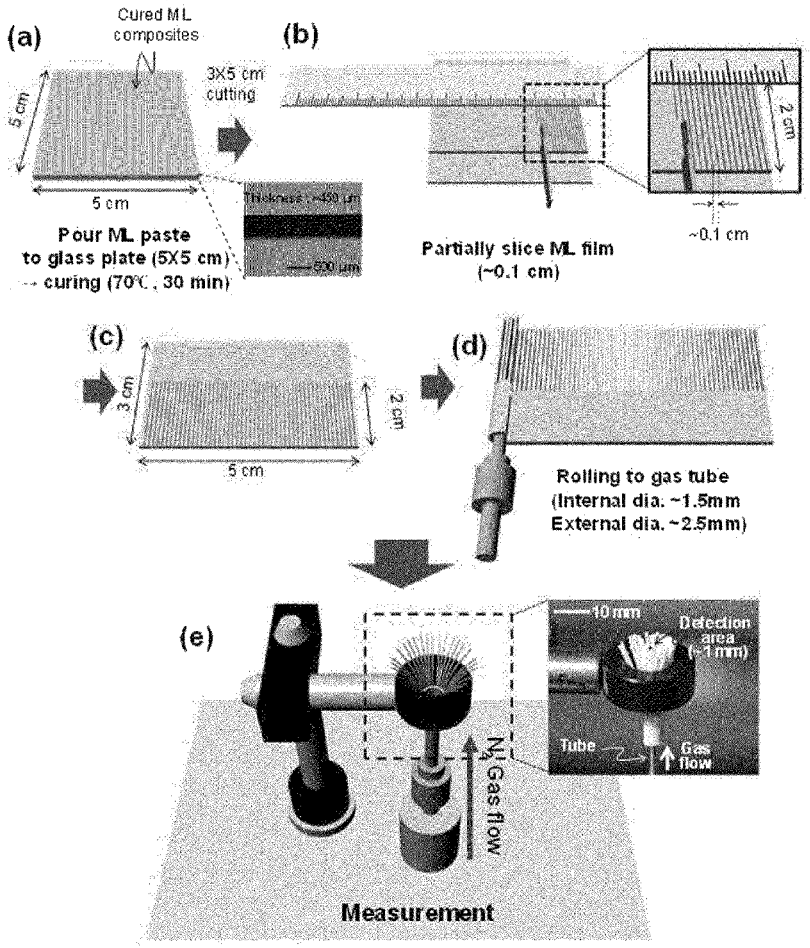

Fig. 3. Schematic illustration of fabricating wind-driven ML samples. a, Pour ML paste to glass plate (5X5 cm) and cure it at 70 °C for 30 min. b, partially slice ML film with the distance of ~1 mm. c, Cut ML film to make 3X5 cm size. d, Roll it to gas tube with internal and external diameter of ~1.5 mm and ~2.5 mm, respectively. e, Set to the gas flow system with ring-type optical unit (internal diameter: 12.7 mm). The role of optical unit enables stable measurement under high gas flow rate by minimizing unstable movement of emitting region.

Fig. 4. Optical characteristics of the wind-driven ML. a, Photographs of partially sliced ML composite enclosed by ring holder. b-d, ML spectra from ML composites (B+, G+ and O+PDMS) during gas flow with the conditions of 30, 40, 50, 60, 70, 80 lpm. Note that 80 lpm is experimental limit condition of our system. e, Brightness, f, CIE coordinates and g-i, photographs obtained from the wind-driven ML.

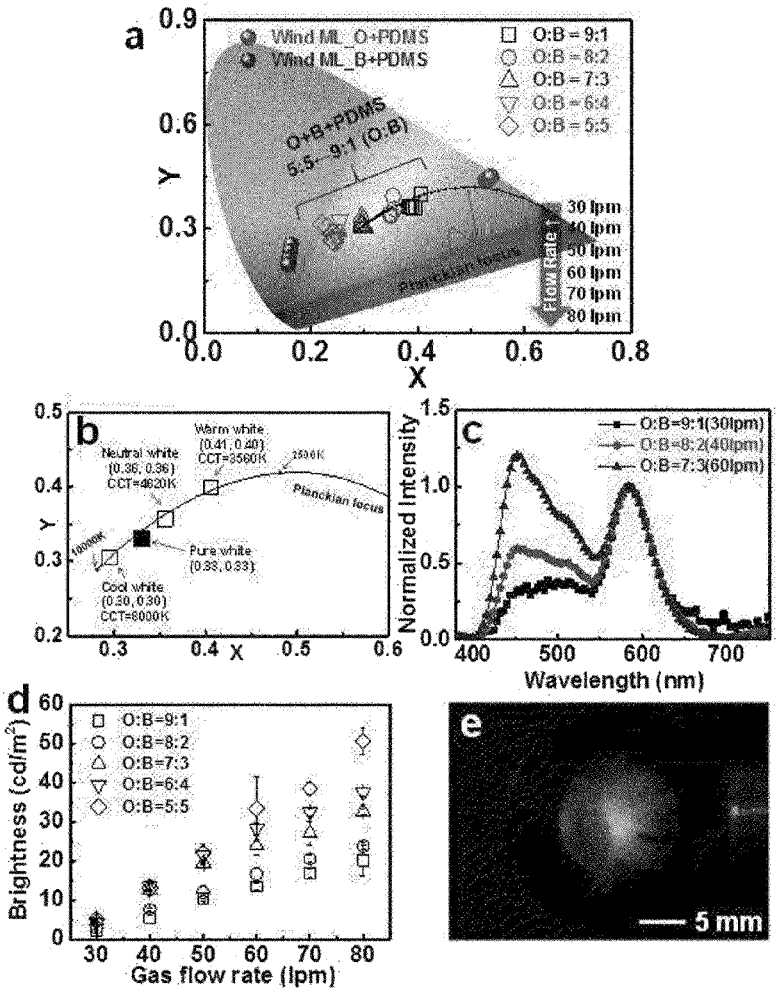

Fig. 5. Colour characteristics of wind-driven ML composites with different mixing ratios in O+B+PDMS. O:B ratios are varied from 9:1, 8:2, 7:3, 6:4 and 5:5. a, CIE coordinates of all wind-driven ML composites. b, magnified CIE coordinates which close to black body radiation locus (planckian locus), and c, ML spectra normalized by 586 nm obtained from O:B=9:1 (30 lpm), O:B=8:2 (40 lpm) and O:B=7:3 (60 lpm) samples. d, brightness of all wind- driven ML composites. e, Photographs of cool white ML obtained from O:B=7:3 sample under 60 lpm condition.

Fig. 6. Wind-driven ML spectra obtained from O+B+PDMS. a, c, e, g, i, intensity and b, d, f, h, j, calculated normalized intensity by 586 nm.

FIG.7

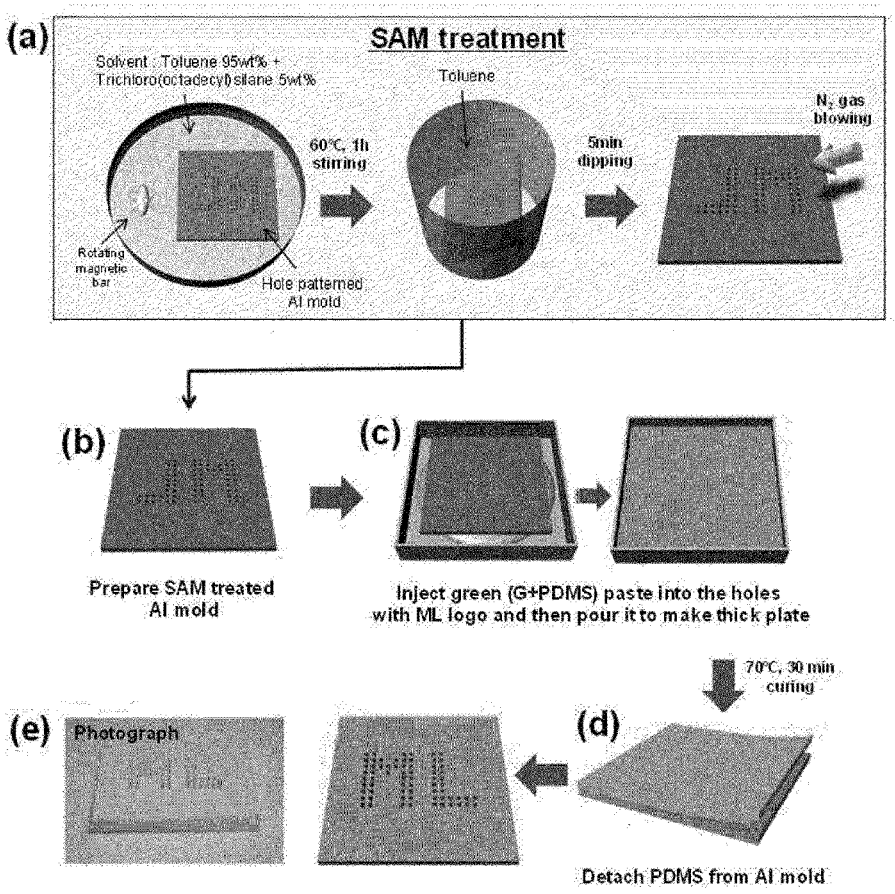

Fig. 7. Schematic illustration of fabricating wind-driven patterned ML sample (green "ML" only) a, SAM surface treatment of Al mold with "ML" patterned holes using mixed solvent of toluene (95 wt%) and Trichloro(octadecyl)silane (5 wt%). b-c, Inject green (G+PDMS) paste into the holes with ML logo and then pour it to make thick plate. d-e, After curing (70 °C for 30 min), separate PDMS from Al mold.

FIG.8

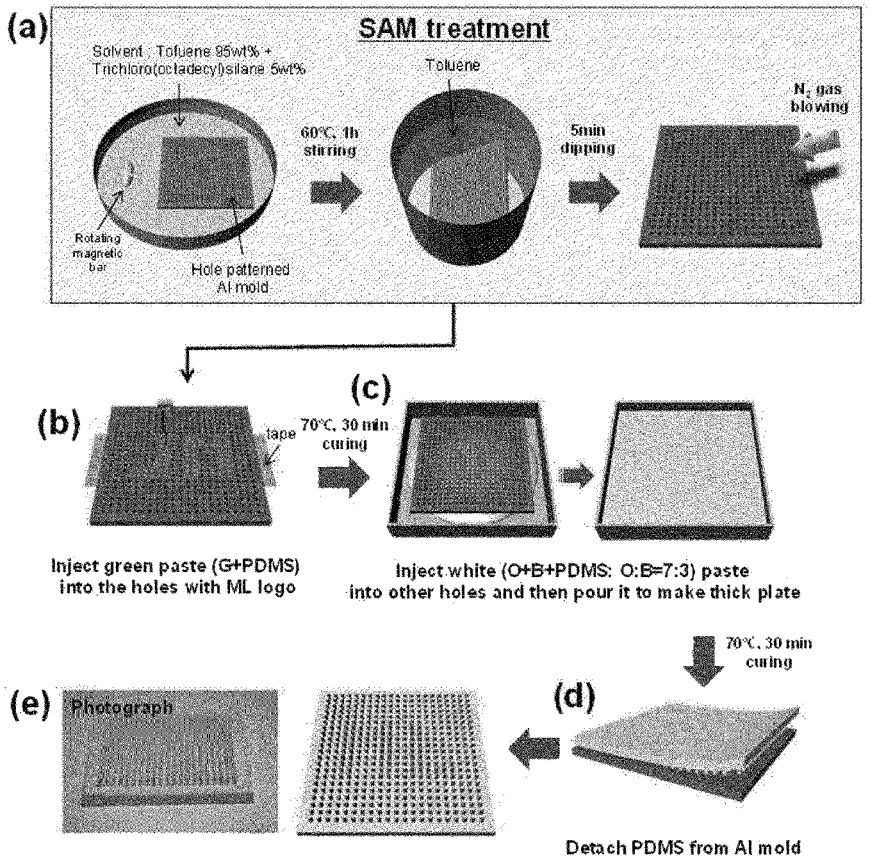

Fig. 8. Schematic illustration of fabricating wind-driven patterned ML sample (green "ML" and white background). a, SAM surface treatment of Al mold with "ML" patterned holes using mixed solvent of toluene (95 wt%) and Trichloro(octadecyl)silane (5 wt%). b, Inject green (G+PDMS) paste into the holes with ML logo. c, Inject white (O+B+PDMS; O:B=7:3) paste into other holes and then pour it to make thick plate. d-e, After curing (70 °C for 30 min), separate PDMS from Al mold.

Fig. 9. Patterned wind-driven ML characteristics. a, Schematic illustration, and b-d, photographs of two samples under general fluorescent light circumstance. e-f, Photographs of wind-driven ML. g, ML spectra obtained from spot A and B during gas flow as marked in e and f.

MECHANOLUMINESCENT DISPLAY DEVICE

CROSS REFERENCE TO RELATED APPLICATIONS

This application is a National Stage of International Application No. PCT/KR2014/012089 filed Dec. 10, 2014, claiming priority based on Korean Patent Application No. 10-2014-0070171 filed Jun. 10, 2014, the contents of all of which are incorporated herein by reference in their entirety.

TECHNICAL FIELD

The following description relates to a display device, and more particularly, to a display device emitting light in a mechanical method using wind and vibration.

BACKGROUND ART

A phenomenon of emitting light in a mechanical method, that is, light generated by applying a strength to a material has been known as mechanoluminescence (a superordinate concept including triboluminescence, fractoluminescence, deformation-luminescence, etc.) for a long time, but a principle of emitting the light is uncertain even until now and also has been treated as only an academic interest.

For example, X-ray emission due to a separation phenomenon of scotch tape in a vacuum (Camara et al. Nature 2008) and ultraviolet (UV) ray emission due to an ultrasonic wave (Eddingsaas et al. Nature 2006), etc. caused a great response academically, but industrial applicability is very low due to a fundamental problem that the light is generated by friction or destruction.

In order to solve the problem related to the industrial applicability, Xu group of the Japanese National Institute of Advanced Industrial Science and Technology (AIST) has tried to apply a non-destructive mechanoluminescent phenomenon, which is deformation luminescence generating the light by elastic or plastic deformation in some materials, to a stress sensor instead of triboluminescence and fractoluminescence generated due to a phenomenon such as friction and destruction.

However, a UV cured polymer is used as a stress transmission material transmitting a mechanical strength to a luminescent material, which is a parent material of emitting light, and thus a lifetime is extremely limited since it is difficult to apply repeated stresses. Further, studies related to the mechanoluminescence are limited to the luminescent material itself until now, and there are no studies related to the stress transmission material transmitting the stress.

Further, in order to apply the mechanoluminescent phenomenon to various industries, brightness, a lifetime, and a color control are very important factors, but many studies have not been performed due to a limitation of the material itself until now. Particularly, technological developments related to the color control do not exist due to the brightness of the light emitted from the material and the limitation of the lifetime (or reproducibility).

DISCLOSURE

Technical Problem

The present invention is directed to providing a mechanoluminescent display device capable of controlling two or more colors independently by mixing two or more stress luminescent materials with a stress transmission material equally.

Technical Solution

An aspect of the present invention provides a mechanoluminescent display device, including: a substrate having a predetermined shape, and projections formed with a predetermined pattern on the substrate, wherein the projections are formed of a mixture of a stress luminescent material emitting light by mechanical energy which is applied and a stress transmission material transmitting the mechanical energy applied from the outside to the stress luminescent material.

The projections included in a first area among the projections which form a predetermined pattern may include a first stress luminescent material, and the projections included in a second area may include a second stress luminescent material different from the first stress luminescent material.

The first stress luminescent material and the second stress luminescent material may have light emitting spectrums different from each other according to the mechanical energy applied from the outside.

At least one characteristic among an optical spectrum, brightness, and a color coordinate of each of the first stress luminescent material and the second stress luminescent material may be varied as a period of transmitting the mechanical energy applied to the first stress luminescent material and the second stress luminescent material is varied.

The second stress luminescent material may emit white light as the mechanical energy is applied, and a mixing ratio of red and blue phosphors in the second stress luminescent material may be at least one of 9:1, 8:2, 7:3, 6:4, and 5:5.

The stress transmission material may be an organic material with elasticity in which transmittance is 80% or more in a visible ray region, and the elastic organic material may be formed of at least one among polydimethylsiloxan (PDMS), a silicon rubber, and an ultraviolet (UV) cured epoxy.

Advantageous Effects

As described above, according to an embodiment of the present invention, application fields of a mechanoluminescent phenomenon limited to a conventional academic study may be expanded to industries. First, the mechanoluminescent phenomenon may be applied to the lighting and the display through a color control, and also be applied to a biology industry such as an artificial skin, etc., and an imaging industry. Particularly, since mechanical energy due to a natural phenomenon such as wind and vibration, etc. is converted into light energy, external power is not required, and it has a great ripple effect as environment-friendly technology interlinked with environment crisis and resource crisis due to a high oil price.

DESCRIPTION OF DRAWINGS

FIG. 1 is a diagram for describing optical characteristics of a stress luminescent device in various stretching-releasing speeds according to an embodiment of the present invention;

FIG. 2 is a diagram for describing a stretching-releasing test for testing optical characteristics of a stress luminescent device according to an embodiment of the present invention;

FIG. 3 is a diagram for describing sample fabrication of the wind-stress luminescent device according to an embodiment of the present invention;

FIG. 5 is a diagram for describing optical characteristics according to a wind-stress luminescent device in which blue and red fluorescent substances are mixed according to an embodiment of the present invention;

FIG. 7 is a diagram for describing a mechanoluminescent display device using a stress luminescent device according to one embodiment of the present invention;

FIG. 8 is a diagram for describing a mechanoluminescent display device using a stress luminescent device according to another embodiment of the present invention.

MODES OF THE INVENTION

Figure 4:
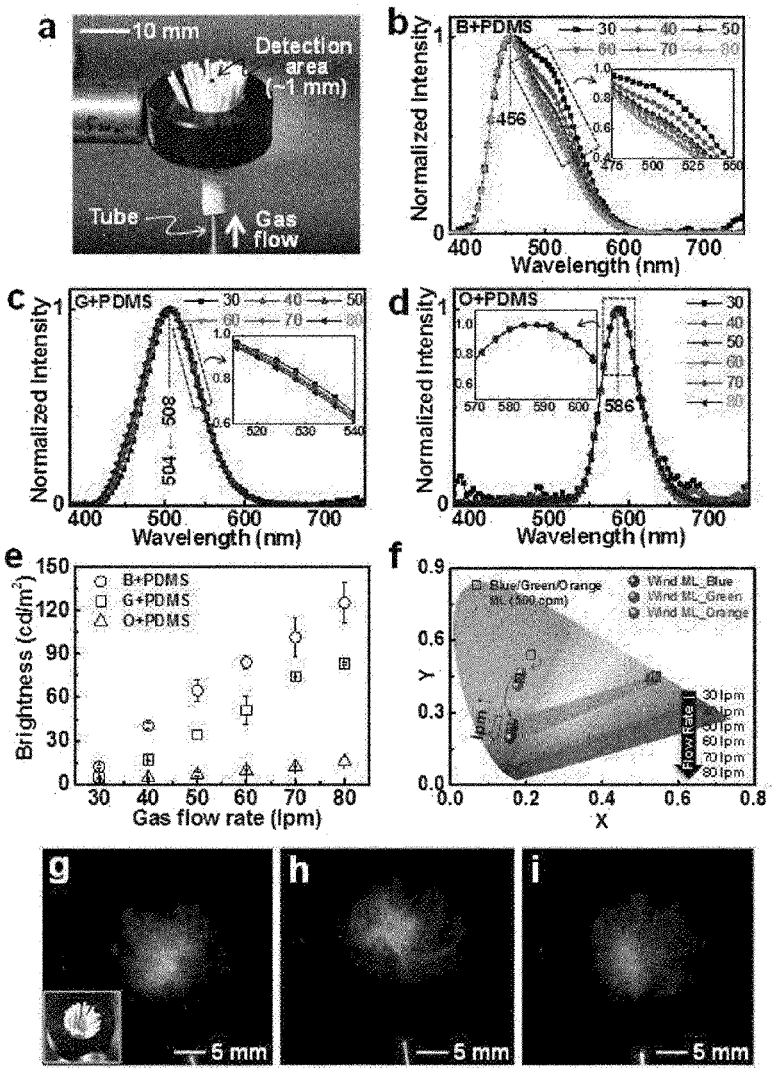
FIG. 4 is a diagram for describing optical characteristics of a stress luminescent device in various wind speeds according to an embodiment of the present invention.

The above and other objects, features and advantages of the present invention will become more apparent with reference to exemplary embodiments which will be described hereinafter with reference to the accompanying drawings. However, the present invention is not limited to exemplary embodiments which will be described hereinafter, and can be implemented by various different types. Exemplary embodiments of the present invention are described below in sufficient detail to enable those of ordinary skill in the art to embody and practice the present invention. The present invention is defined by claims. Meanwhile, the terminology used herein to describe exemplary embodiments of the invention is not intended to limit the scope of the invention. The articles "a," "an," and "the" are singular in that they have a single referent, but the use of the singular form in the present document should not preclude the presence of more than one referent.

Hereinafter, exemplary embodiments of the present invention will be described in detail with reference to the accompanying drawings. First, when allocating reference numerals to components of each drawing, the same reference numeral will be allocated to the same component even when being shown in different drawings. Further, in the following description with respect to the exemplary embodiments of the present invention, when it is determined that a detailed description of well-known technology related to the present invention can unnecessarily obscure a subject matter of the present invention, the description will be omitted.

FIG. 1 is a diagram for describing optical characteristics of a stress luminescent device in various stretching-releasing speeds according to an embodiment of the present invention.

FIG. 1*a* illustrates optical spectrum characteristics of a stress luminescent device (a stress luminescent material+a stress transmission material, B+PDMS) emitting blue light when a stretching-releasing rate is increased from 100 cycles per minute (cpm) to 500 cpm, FIG. 1*b* illustrates optical spectrum characteristics of a stress luminescent device (G+PDMS) emitting green light when the stretching-releasing rate is increased from 100 cpm to 500 cpm, and FIG. 1*c* illustrates optical spectrum characteristics of a stress luminescent device (O+PDMS) emitting red light when the stretching-releasing rate is increased from 100 cpm to 500 cpm.

As shown in FIGS. 1*a* to 1*c*, the stress luminescent devices respectively emitting the blue, green, and red lights may have characteristics in which light intensity is increased as the stretching-releasing rate is increased. Further, with reference to FIG. 1*d*, the stress luminescent devices respectively emitting the blue, green, and red lights may have characteristics in which brightness is increased as the stretching-releasing rate is increased.

Here, it should be noted that a color close to the green color is emitted when the stress luminescent material emitting the blue light is mixed with the stress transmission material such as poldimethylsiloxane (hereinafter, PDMS). This may indicate that it is not easy to excite the stress luminescent material of the blue color mixed with the stress transmission material using a stretching-releasing tester of FIG. 2.

Meanwhile, light having a different wavelength may be emitted when a period of generating a stress which is applied to the stress luminescent material is varied even with the same stress luminescent material.

For example, in an embodiment of the present invention, copper-doped zinc sulfide (hereinafter, ZnS:Cu) may be used as the stress luminescent material emitting the blue and green lights, and copper and manganese-doped zinc sulfide (hereinafter, ZnS:Cu,Mn) may be used as the stress luminescent material emitting the red light. That is, the ZnS:Cu may be equally used as the stress luminescent material emitting the blue and green lights, but as the period of generating the stress applied to the ZnS:Cu is varied, the blue light or the green light may be emitted. This may be because a doping position of Cu in the ZnS:Cu is located in various energy levels. That is, as the stress change rate is increased, light of a wavelength range having high energy may be emitted.

As another example, ZnS:Mn, ZnS:Cu,Mn, ZnS:Cu,Pb, ZnS:Cu,Pb,Mn, MgF2:Mn, La2O2S:Eu, Y2O2S:Cu, EuD4TEA, EuD4TEA+1.25 mL DMMP, ZnS:Cu,Cl, ZnS:Cu,Mn,Cl, SrAl2O4:Eu, SrAl2O4:Ce, SrAl2O4:Ce,Ho, SrMgA16O11:Eu, SrCaMgSi2O7:Eu, SrBaMgSi2O7:Eu, Sr2MgSi2O7:Eu, Ca2MgSi2O7:Eu,Dy, CaYA13O7:Eu(Ba, Ca), TiO3:Pr3+, ZnGa2O4:Mn, MgGa2O4:Mn, Ca2Al2SiO7:Ce, ZrO2:Ti, ZnS:Mn,Te, etc. may be used as the stress luminescent material, and the stress luminescent material capable of being used for the present invention is not limited to materials described herein, and all kinds of materials emitting which accompany an infinitesimal deformation with light may be used.

Further, an organic material (the stress transmission material) may include the PDMS, and a silicon rubber or ultraviolet (UV) curable epoxy, etc. which is optically transparent (transmittance which is equal to or more than 80% in a visible ray region) and has high durability may be widely used.

Meanwhile, in order to fabricate the stress luminescent device according to an embodiment of the present invention, a material characteristic of an improved mechanoluminescent strength and lifetime should be preserved. For this, in an embodiment of the present invention, a transparent PDMS having strong elasticity and good durability may be used as the stress transmission material.

The PDMS may have the following three advantages as the stress transmission material.

1. Since the PDMS has low interfacial free energy when being mixed with the stress luminescent material, the PDMS may not bond to the stress luminescent material. When the stress luminescent material and the stress transmission material are strongly bonded, the interfacial state may be destroyed by slipping on the bonded surface in various deformation states, but the PDMS may have no adverse effect on a surface of the stress luminescent material and transmit repetitive stress safely.

2. Since the PDMS is transparent, the mechanoluminescent light may be fully transmitted to the outside without optical loss.

3. Since the PDMS has strong durability, the PDMS may not be destroyed even when the repetitive stress is applied for a long time.

FIGS. 1*e* and 1*f* illustrate a comparison between an optical spectrum (EL) and a color coordinate of a case in which the stress luminescent device emitting the blue, green, and red lights is electroluminescent, and an optical spectrum (ML) and a color coordinate of a case in which the stress luminescent device emitting the blue, green, and red lights is mechanoluminescent. With reference to FIGS. 1*e* and 1*f*, the optical characteristics of the case in which the stress luminescent device is electroluminescent and the case in which the stress luminescent device is mechanoluminescent are the same or similar.

FIG. 2 is a diagram for describing a stretching-releasing test for testing optical characteristics of a stress luminescent device according to an embodiment of the present invention.

With reference to FIG. 2, first, the stress luminescent materials emitting the blue, green, and red lights may be put into a PDMS solution (a), a PDMS particle and each of the stress luminescent materials may be mixed so as to be distributed evenly (b). In this case, a mixer may be used, and it may be desirable that a weight ratio between each stress luminescent material and the PDMS solution is 7:3.

After this, a mixture of the stress luminescent material and the PDMS solution may be poured into a mold, and a heat curing process may be performed by leaving the mixture for 30 minutes in a temperature environment of 70° C. (c, d, and e).

Next, the heat-cured mixture of the stress luminescent material and the PDMS solution may be separated from the mold, and a stress luminescent device sample for a stretching-releasing test may be generated (f).

A stretching-releasing system may be used in order to observe the optical characteristics of the mechanoluminescence emitted from the stress transmission device, and an example of the stretching-releasing test is illustrated in FIGS. 2*g* to 2*i*.

The stress luminescent device sample generated through the process described above may be fixed to a stretching-releasing tester (g), and a stretching-releasing process may be repeated in a predetermined speed (h, i).

FIG. 3 is a diagram for describing an optical characteristic test according to a wind-stress luminescent device according to an embodiment of the present invention.

With reference to FIG. 3, first, the heat curing process may be performed so as to have a predetermined thickness by pouring the stress luminescent device of a liquid state on a glass plate (a). After this, a portion of the heat-cured stress luminescent device may be cut in a predetermined interval (b, c), the cut portion of the heat-cured stress luminescent device may be rolled up by a gas tube (d), and the optical characteristics of the stress luminescent device emitting the light may be observed by gas emitted from the gas tube (e).

FIG. 4 is a diagram for describing optical characteristics of a stress luminescent device according to an embodiment of the present invention.

FIG. 4*b* illustrates optical spectrum characteristics of the stress luminescent device (the stress luminescent material+the stress transmission material, B+PDMS) emitting the blue light when a gas flow rate is increased from 30 liters per minute (lpm) to 80 lpm, FIG. 4*c* illustrates optical spectrum characteristics of the stress luminescent device (G+PDMS) emitting the green light when the gas flow rate is increased from 30 lpm to 80 lpm, and FIG. 4*d* illustrates optical spectrum characteristics of the stress luminescent device (O+PDMS) emitting the red light when the gas flow rate is increased from 30 lpm to 80 lpm.

As shown in FIGS. 4*b* to 4*d*, the stress luminescent devices respectively emitting the blue, green, and red lights may have characteristics maintaining a predetermined optical intensity even when the gas flow rate is increased. Further, with reference to FIG. 4*e*, the stress luminescent devices respectively emitting the blue, green, and red lights may have characteristics in which the brightness is increased as the gas flow rate is increased. FIG. 4*f* illustrates a change of a color coordinate of the stress luminescent devices respectively emitting the blue, green, and red lights as the gas flow rate is increased, and FIGS. 4*g* to 4*i* illustrate images in which the blue, green, and red lights are emitted by wind.

With reference to FIG. 4*f*, the blue color stress luminescent device may emit a color close to the green color in the stretching-releasing test described with reference to FIG. 1, but emit a color remarkably close to the blue color by the wind. Accordingly, when suitably mixing the red color stress luminescent material and the blue color stress luminescent material, it may be induced that it is possible to emit white light by the mechanical energy such as the wind and vibration. This will be described below with reference to FIGS. 5 and 6.

FIG. 5 is a diagram for describing optical characteristics according to a wind-stress luminescent device in which blue and red color phosphors are mixed according to an embodiment of the present invention.

FIGS. 5*a* and 5*b* illustrate a change of a color coordinate of the stress luminescent device in which the red and blue color phosphors are mixed at mixing ratios of 9:1, 8:2, 7:3, 6:4, and 5:5. With reference to FIGS. 5*a* and 5*b*, it may be confirmed that the white light having various color temperatures may be implemented by mixing the red and blue color phosphors, and warm/neutral/cool white light may be implemented at a specific mixing ratio.

FIG. 5*c* illustrates optical spectrum characteristics of a case in which gas is applied to the stress luminescent device in which the red and blue color phosphors are mixed at the mixing ratio of 9:1 at a flow rate of 30 lpm, a case in which the gas is applied to the stress luminescent device in which the red and blue color phosphors are mixed at the mixing ratio of 8:2 at a flow rate of 40 lpm, and a case in which the gas is applied to the stress luminescent device in which the red and blue color phosphors are mixed at the mixing ratio of 7:2 at a flow rate of 60 lpm.

FIG. 5*d* illustrates the change of the brightness according to the gas flow rate of the stress luminescent device in which the red and blue color phosphors are mixed at the mixing ratios of 9:1, 8:2, 7:3, 6:4, and 5:5, and FIG. 5*e* illustrates an example of an image in which the stress luminescent device in which the red and blue color phosphors are mixed at the mixing ratio of 7:3 emits the cool white light.

Figure 6:
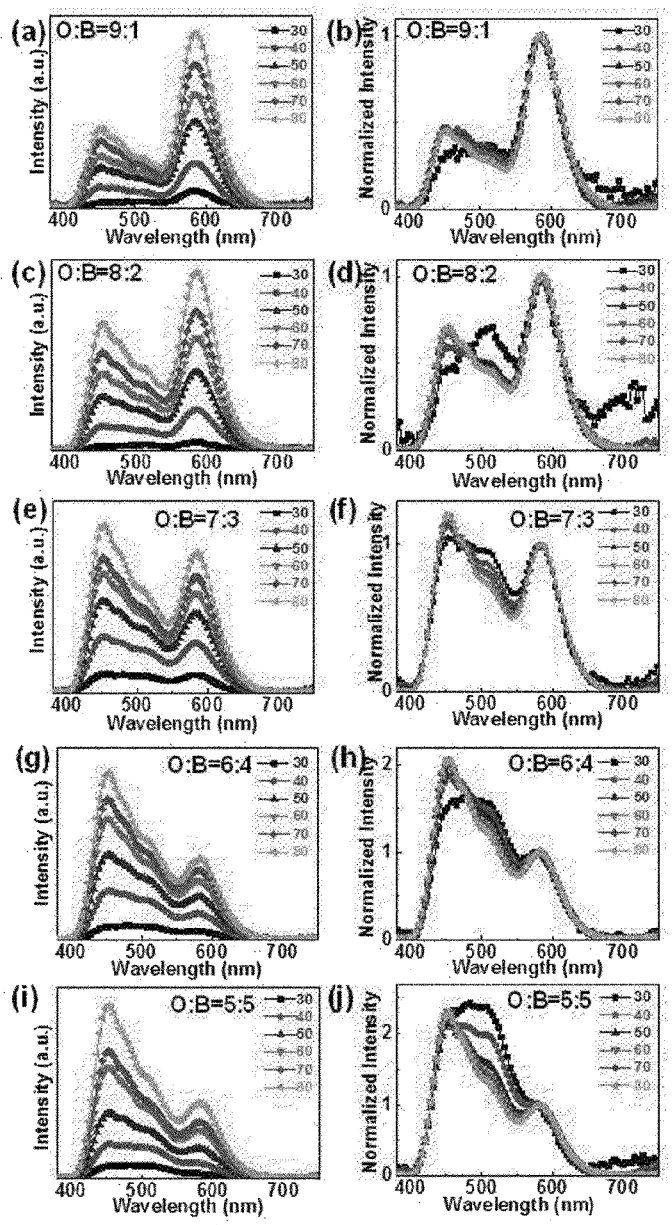
FIG. 6 is a diagram for describing optical spectrum characteristics according to the wind-stress luminescent device in which blue and red fluorescent substances are mixed according to an embodiment of the present invention.

FIG. 6 is a diagram for describing optical spectrum characteristics according to the wind-stress luminescent device in which blue and red color phosphors are mixed according to an embodiment of the present invention.

FIGS. 6*a*, 6*c*, 6*e*, 6*g*, and 6*i* illustrate the optical spectrum characteristics according to the gas flow rate of the stress luminescent device in which the red and blue color phosphors are mixed at the mixing ratios of 9:1, 8:2, 7:3, 6:4, and 5:5, and FIGS. 6*b*, 6*d*, 6*f*, 6*h*, and 6*j* illustrate normalized optical spectrum characteristics. With reference to FIG. 6, it may be confirmed that the white light (586 nm) is emitted according to the gas flow rate in the stress luminescent device in which the red and blue color phosphors are mixed at mixing ratios of 9:1, 8:2, 7:3, 6:4, and 5:5.

Hereinafter, a mechanoluminescent display device fabricated using the stress luminescent device described above will be described with reference to FIGS. 7 to 9. FIG. 7 is a diagram for describing a mechanoluminescent display device using a stress luminescent device according to one embodiment of the present invention.

Meanwhile, it may be understood that the display device described herein may include a device of converting an electric signal to an image in an electronic device such as a television (TV), a mobile terminal, etc., and also may include all kinds of media capable of transmitting visual information such as traffic signs and advertising signs, etc. installed on a road.

With reference to FIG. 7, in the mechanoluminescent display device according to one embodiment of the present invention, only a specific portion may be configured as a projection of a stress luminescent device component, and remaining portions besides the specific portion may be configured as a stress transmission material.

In FIG. 7, a mechanoluminescent display device in which only a portion corresponding to ML is configured as the stress luminescent device is illustrated so as to emit light only an ML logo. Here, the stress luminescent device may be configured as projections having a predetermined pattern on a substrate having a predetermined shape.

When describing a process of fabricating the mechanoluminescent display device according to one embodiment of the present invention, first, a mold having an aluminum component in which a self assembled monolayer (SAM) treatment is performed may be provided (a). Here, holes having an ML pattern may be formed with a predetermined interval in the mold.

Next, a stress luminescent device (G+PDMS) paste emitting green light may be injected into the holes of the ML pattern, and a stress transmission material (PDMS) paste may be applied to every area of the mold (c).

After this, the heat curing process may be performed by leaving the applied stress luminescent paste and the stress transmission material paste for 30 minutes in the temperature environment of 70° C., and the paste which completed the heat curing process may be separated from the mold (d, e). As a result, the mechanoluminescent display device including the projections (having the stress luminescent device component emitting the green light) formed with a predetermined pattern ML on the plate formed of the stress transmission material PDMS may be fabricated.

FIG. 8 is a diagram for describing a mechanoluminescent display device using a stress luminescent device according to another embodiment of the present invention.

With reference to FIG. 8, the mechanoluminescent display device using a stress luminescent device according to another embodiment of the present invention may include projections of the stress luminescent device component configured in every area on the plate. For example, the mechanoluminescent display device using a stress luminescent device according to another embodiment of the present invention may be configured as a plate with the projections formed in a predetermined pattern in every area on the plate, the projections included in a first area among the projections formed in the predetermined pattern may include a first stress luminescent material, and the projections included in a second area may include a second stress luminescent material different from the first stress luminescent material.

In FIG. 8, a mechanoluminescent display device in which the ML logo is formed by the projections having the stress luminescent device component emitting the green light and projections having stress luminescent device component emitting white light are formed in a remaining portion is illustrated. A process of fabricating the mechanoluminescent display device will be described in detail below.

First, a mold of the aluminum component in which the SAM treatment is performed may be provided (a). Here, holes may be formed with a predetermined interval in every area of the mold.

Next, the stress luminescent device (G+PDMS) paste emitting the green light may be injected into the holes having the ML pattern, and the stress luminescent device (O+B+PDMS) paste emitting the white light may be injected into the remaining holes, then the stress luminescent device (O+B+PDMS) paste emitting the white light may be applied to every area of the mold (c).

After this, the heat curing process may be performed by leaving the applied stress luminescent device paste for 30 minutes in the temperature environment of 70° C., and the paste which completed the heat curing process may be separated from the mold (d, e). As a result, the mechanoluminescent display device including the projections (the projections corresponding to the ML logo may have the stress luminescent device component emitting the green light, and the remaining projections may have the stress luminescent device component emitting the white light) formed with a predetermined interval in every area on the plate formed by the stress luminescent device (O+B+PDMS) emitting the white light may be fabricated.

Figure 9:
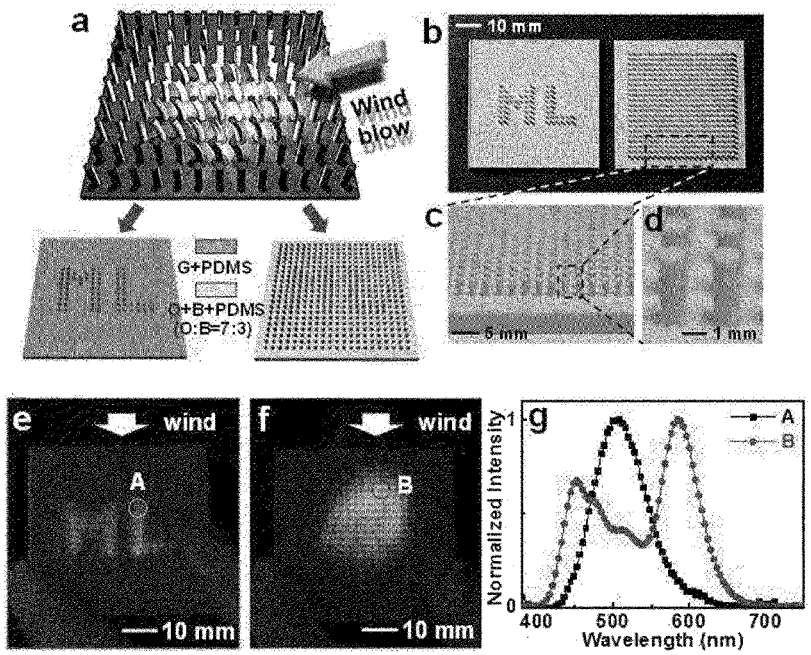
FIG. 9 is a diagram for describing optical characteristics of the mechanoluminescent display devices shown in FIGS. 7 and 8.

FIG. 9 is a diagram for describing optical characteristics of the mechanoluminescent display devices shown in FIGS. 7 and 8.

FIG. 9*a* is a diagram illustrating shapes of the mechanoluminescent display devices shown in FIGS. 7 and 8, the mechanoluminescent display device which is actually fabricated by the fabricating method described with reference to FIG. 7 is illustrated on the left side of FIG. 9B, and the mechanoluminescent display device which is actually fabricated by the fabricating method described with reference to FIG. 8 is illustrated on the right side of FIG. 9B.

FIGS. 9*c* and 9*d* illustrate drawings of enlarged shapes of the projections formed according to an embodiment of the present invention. Meanwhile, an example in which a projection having a cylindrical shape in which a diameter is 1 mm and a length is 3 mm is formed is illustrated in FIG. 9, but is not limited thereto.

FIGS. 9*e* and 9*f* illustrate light emitting images of the mechanoluminescent display devices according to an embodiment of the present invention, respectively, FIG. 9*g* illustrates spectrum characteristics of light emitted in the projection included in an area A, and FIG. 9*f* illustrates spectrum characteristics of light emitted in the projection included in an area B.

The above description is merely exemplary embodiments of the scope of the present invention, and it will be apparent to those skilled in the art that various modifications can be made to the above-described exemplary embodiments of the present invention without departing from the spirit or the scope of the invention. Accordingly, exemplary embodiments of the present invention are not intended to limit the scope of the invention but to describe the invention, and the scope of the present invention is not limited by the exemplary embodiments. Thus, it is intended that the present invention covers all such modifications provided they come within the scope of the appended claims and their equivalents.

The invention claimed is:

1. A mechanoluminescent display device, comprising:

a substrate having a predetermined shape; and projections formed with a predetermined pattern on the substrate, wherein the projections are formed of a mixture of a stress luminescent material emitting light by mechanical energy which is applied from outside and a stress transmission material transmitting the mechanical energy applied from the outside to the stress luminescent material; and wherein the stress transmission material is a polydimethylsiloxan or a silicon rubber, wherein the pattern comprises a first area and a second area, wherein projections included in the first area include a first stress luminescent material, and projections included in the second area include a second stress luminescent material, said second stress luminescent material being different from the first stress luminescent material, and wherein the first stress luminescent material and the second stress luminescent material have light emitting spectrums different from each other.

2. The mechanoluminescent display device of claim 1, wherein at least one characteristic selected from the group consisting of an optical spectrum, brightness, and a color coordinate, of each of the first stress luminescent material and the second stress luminescent material varies in accordance with a change in a period of transmitting the mechanical energy applied to the first stress luminescent material and the second stress luminescent material.

3. The mechanoluminescent display device of claim 1, wherein the second stress luminescent material emits white light as the mechanical energy is applied, and a mixing ratio of red and blue phosphors in the second stress luminescent material is at least one of 9:1, 8:2, 7:3, 6:4, and 5:5.

4. The mechanoluminescent display device of claim 1, wherein the mechanical energy is wind or vibration.

* * * * *